US005243801A

United States Patent [19]

Aiken et al.

[11] Patent Number: 5,243,801

[45] Date of Patent: Sep. 14, 1993

[54] REFRACTORY TILE FOR HEAT EXCHANGER PROTECTION

[75] Inventors: Donald B. Aiken, Ligonier; Stanley Gursky, Newtown, both of Pa.; Wayne P. Hults, Rittman; David T. Wasyluk, Mogadore, both of Ohio

[73] Assignees: The Babcock & Wilcox Company, New Orleans, La.; The Carborundum Company, Niagara Falls, N.Y.; a part interest

[21] Appl. No.: 839,516

[22] Filed: Feb. 20, 1992

[51] Int. Cl.[5] ..... F22B 37/40

[52] U.S. Cl. ..... 52/474; 52/486; 52/586; 122/6 A

[58] Field of Search ..... 52/320, 321, 322, 323, 52/324, 325, 506, 509, 586, 474, 486; 110/325, 336, 338, 339, 340; 122/6 A

[56] References Cited

U.S. PATENT DOCUMENTS

| | | | |
|---|---|---|---|
| 1,719,642 | 7/1929 | Bailey | 122/6 A |
| 3,012,525 | 12/1961 | Thomas, Sr. et al. | 110/339 |
| 3,199,477 | 8/1965 | Marsh, Jr. | 110/336 |
| 4,809,645 | 3/1989 | Fournier et al. | 122/6 A |

*Primary Examiner*—Carl D. Friedman
*Assistant Examiner*—Matthew E. Leno
*Attorney, Agent, or Firm*—Richard L. Hansen; Michael L. Hoelter

[57] ABSTRACT

A refractory tile adapted for protective fixation to the heat exchanger in an incinerator or furnace regardless of orientation. The tile includes a transverse groove which carries a shouldered slot to be guided by and mate securely with an anchor attached to the heat exchanger.

5 Claims, 4 Drawing Sheets

REFRACTORY TILE FOR HEAT EXCHANGER PROTECTION

This invention is in the field of refractory materials, especially the field of firebrick and tile. More specifically, this invention relates to the specialized refractory tile employed in furnaces, ovens, incinerators, boilers, etc. to protect heat exchangers therein from the erosive and corrosive effects of flame.

BACKGROUND OF THE INVENTION

It has long been the practice to cover the firebox walls of facilities such as municipal incinerators with a firebrick or tile sheath in order to protect the structural elements thereof, the walls and the ceilings, from the erosive and corrosive effects of the fire. Many of these facilities now include energy recovery systems which operate to retrieve the heat generated during the combustion process. In many cases the energy recovery system comprises a boiler, including an array of metal tube walls through which water is circulated as a heat transfer medium. This array is often placed at the periphery of the firebox and is also susceptible to the detrimental effects of impinging flame. Therefore, it is desirable to protect this heat exchanger array with its own refractory covering which is suspended from the heat exchanger itself.

In contrast to the firebrick employed to protect the structural elements of the facility, the refractory material used to cover the heat exchanger is seldom simply firebrick held together with mortar but is often a more specialized type of brick or tile with unique characteristics. One of the characteristics required of the brick is high thermal conductivity to the underlying heat exchanger. Another, but related, special requirement is a means for attaching the brick to the heat exchanger. Attachment of the brick has been accomplished in a number of ways.

In U.S. Pat. No. 3,327,445, refractory bricks are suspended on the vertical wall of a furnace on metallic support shoes and hung from vertical "I" beams using "J" bolts anchored in the bricks. U.S. Pat. Nos. 3,328,014 and 3,380,409 disclose furnace wall construction in which tongue and groove mating elements are used to hang refractory brick from a vertical metal framework. In none of these references is the brick hung from a heat exchanger.

U.S. Pat. No. 1,987,738 discloses a steam locomotive firebox which contains an array of tubing through which water is circulated. The heat exchanger on the metallic arch of the firebox, which is inclined from the vertical, is shielded from direct flame with a layer of refractory blocks. The blocks are suspended from and anchored to the array by means of mating tongue and groove structures in the blocks and arch. Boiler tubes in a furnace are protected with refractory brick which is hung from the tubing framework with mated fittings according to U.S. Pat. Nos. 3,850,146 and 3,828,735.

U.S. 3,797,416 discloses protecting boiler tubes from the erosive effects of injected pulverized coal fuel by hanging protective structures from the tubing using mated ear and groove fittings which are wedged together to provide a tight fit to the tubing. Nickel alloy, not refractory brick, is disclosed as the protective structural material, flame not being the erosive agent.

U.S. Pat. No. 4,768,447 describes a firebrick adapted to be hung on a vertical wall of tubing in an incinerator by means of an inclined recess in the firebrick into which a mating projection from the tubing wall fits; the firebrick is held against the tubing by gravity.

Whereas there have been many proprietary methods for hanging protective refractory brick on an array of heat exchanger tubing, few of these methods have commercial significance. The most common method for hanging the firebrick is to run a bolt through the brick and anchor it to the tubing. This technique, while relatively inexpensive, subjects the brick to compressive stresses, which leads to the development of cracks and, ultimately, to failure of the brick. Furthermore, while many of the methods for affixing the bricks may be satisfactory when the array of heat exchanger tubing is vertical, they become unsatisfactory for use when the array is inclined from the vertical toward horizontal; the weight of the bricks then tends to pull them away from the tubing, lowering the thermal conductivity drastically and sharply affecting the efficiency of heat recovery.

For example, the firebrick of U.S. Pat. No. 4,768,447 is forced against the tubing array by gravity only to the extent the array is vertical. To the degree the array is inclined from the vertical, the weight of the brick tends to separate it from the tubing.

SUMMARY OF THE INVENTION

Thus, it is an object of this invention to provide a refractory tile which can be employed effectively on an inclined, including horizontal, tubing array, as well as on a vertical array of heat exchanger tubing. It is another objective to provide a refractory tile which is relatively easy to produce and inexpensive to mount. It is yet another objective to provide a refractory tile system which includes a refractory tile together with a mating anchor to affix the tile to an array of tubing. Still another objective of this invention is to provide a protective covering of tile systems to shield an array of heat exchanger tubing from the erosive and corrosive action of flame while maintaining efficient heat recovery. Other objectives will become apparent hereinafter.

These objectives are attained by this invention in a refractory tile which is particularly adapted for fixation to either vertical or inclined arrays of heat exchanger tubing to produce, with other tile, a monolithic protective covering over the array. Close contact between the tile and the heat exchanger is obtained, regardless of the orientation of the array, thus providing excellent thermal conductivity.

Each refractory tile of this invention includes an exposed face and a concealed face which are spaced apart with an edge. The concealed face of the tile carries at least one groove which is open to the concealed face and extends transversely across the tile from the edge. The groove includes a shouldered slot which terminates on the concealed face of the tile. The underside of the shoulder begins at the slot entrance with a guiding surface tapered into the groove and ends with a securing surface paralleling the groove.

In preferred embodiments, the concealed face of the tile is contoured so that the tile closely engages the heat exchanger through a refractory mortar bond, thereby providing optimum thermal contact. Also in preferred embodiments, the refractory tile carries a recess on its edge to allow fixation of each tile to adjacent tile in the array with mortar.

The invention will be clarified by reference to the drawings which accompany this specification and to the detailed description which follows.

DETAILED DESCRIPTION

Figure 1:
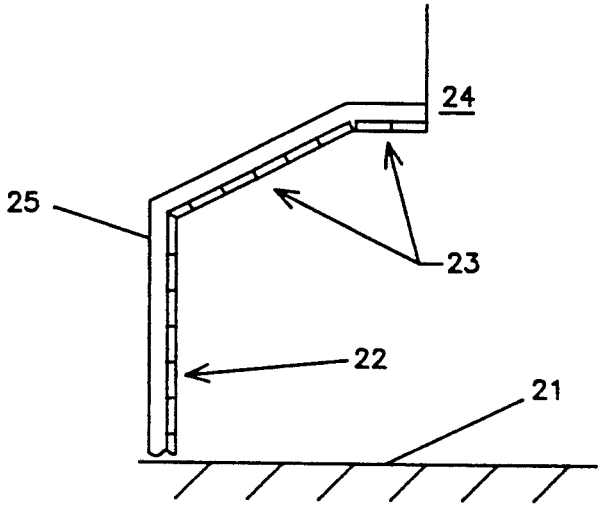
FIG. 1 is a diagramatic cross-sectional view in elevation of a heat exchanger in the interior of a typical incinerator.

With reference now to FIG. 1, above floor 21 of an incinerator or other furnace is supported or suspended heat exchanger 25, which is typically an array of closely spaced metal tubing through which a liquid heat transfer medium is passed. Combustion produces, among other things, gases and particulate matter which exit at stack 24, as well as heat which is to be absorbed by the heat exchanger. The heat exchanger can have vertical and/or inclined portions. The tile systems of this invention can be employed in vertical protective covering 22 or equally well in protective covering 23, which is inclined from the vertical.

Figure 2:
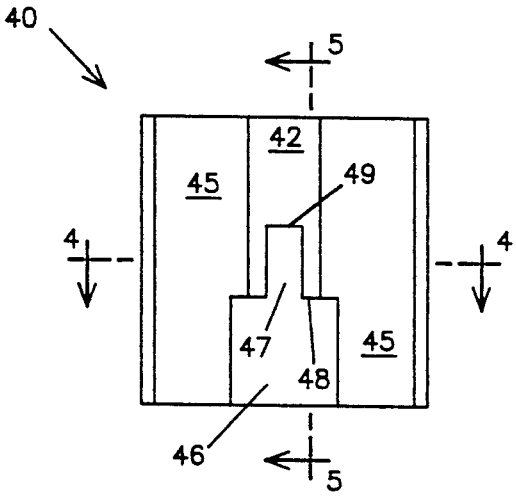
FIG. 2 is a plan view of one embodiment of a refractory tile within the scope of the invention.
Figure 3:
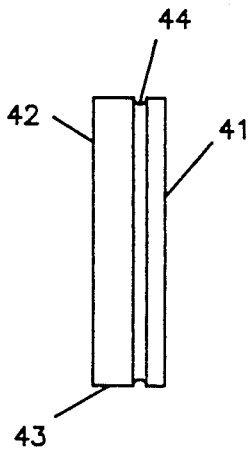
FIG. 3 is a side elevation view of the tile of FIG. 2.

As may be seen by reference especially to FIGS. 2–6, the refractory tile of this invention comprises a ceramic body 40 composed of a thermally resistant but thermally conductive material, the nature of which can be varied as is well known in the art, the specific composition of which is not critical to this invention. The tile is characterized by a face 41, which is intended to be exposed to fire and flame, a face 42, which will typically be in close contact with heat exchanger 25 and concealed from view, and edge 43, which separates and spaces the faces apart. Although tile of other shapes, e.g., triangular or hexagonal, can be employed in the invention, the tile will typically be rectangular in plan as shown in FIG. 2, and, although not a requirement, the faces of the tile will generally be more or less coplanar as shown in FIG. 3. These selections of shape are made for reasons of ease in manufacture and minimum ultimate cost of the tile.

One of the features of the tile is that the concealed face 42 carries at least one groove 46 which extends transversely from the edge of the tile. The single groove which is present in the tile of FIGS. 2–6, or a plurality of such grooves if they are present is/are adapted to guide the tile into position and mate the tile securely with an anchor mounted on the heat exchanger, or a plurality of anchors if the tile carries a plurality of grooves.

Figure 5:
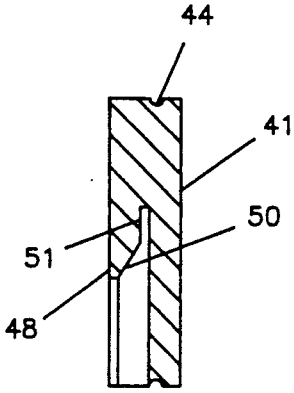
FIG. 5 is a cross-sectional view of the tile taken along line 5—5 in FIG. 2.
Figure 4:
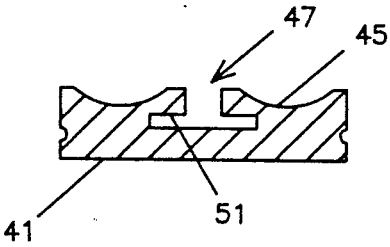
FIG. 4 is a cross-sectional view of the tile taken along line 4—4 in FIG. 2.

The tile can be adapted to mate securely with an anchor mounted on the heat exchanger by providing groove 46 with a shouldered slot 47. In alternative embodiments, the groove 46 can, if desired, extend entirely across the tile. However, in the embodiment shown, groove 46 terminates at about mid-tile as illustrated in FIG. 5. The length and width of groove 46 can vary to suit the dimensions of the anchor. Slot 47 will end at a termination 49 which is a stop for the anchor to rest against, thus permitting installation in a vertical orientation.

The underside of the shoulder 48 begins at the slot entrance with guiding surface 50 which works, in cooperation with a tile anchor member moving into the slot, to force the tile against the heat exchanger. As the anchor member moves further into the slot, the member encounters securing surface 51, locking the tile in place. One advantage of mating the tile securely to an anchor in this way is that, no matter what the orientation of the tile with respect to the vertical, the tile is urged to closely hug the heat exchanger for the most efficient and effective heat transfer.

Figure 7:
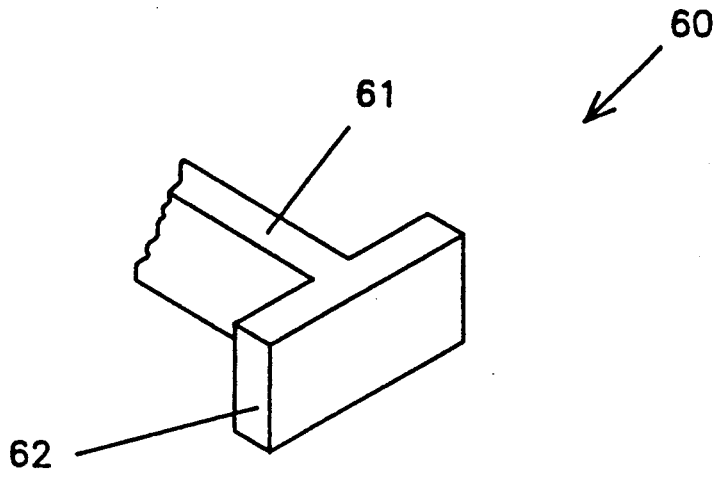
FIG. 7 is an isometric view of a tile anchor to be employed with the tile shown in FIG. 2.
Figure 6:
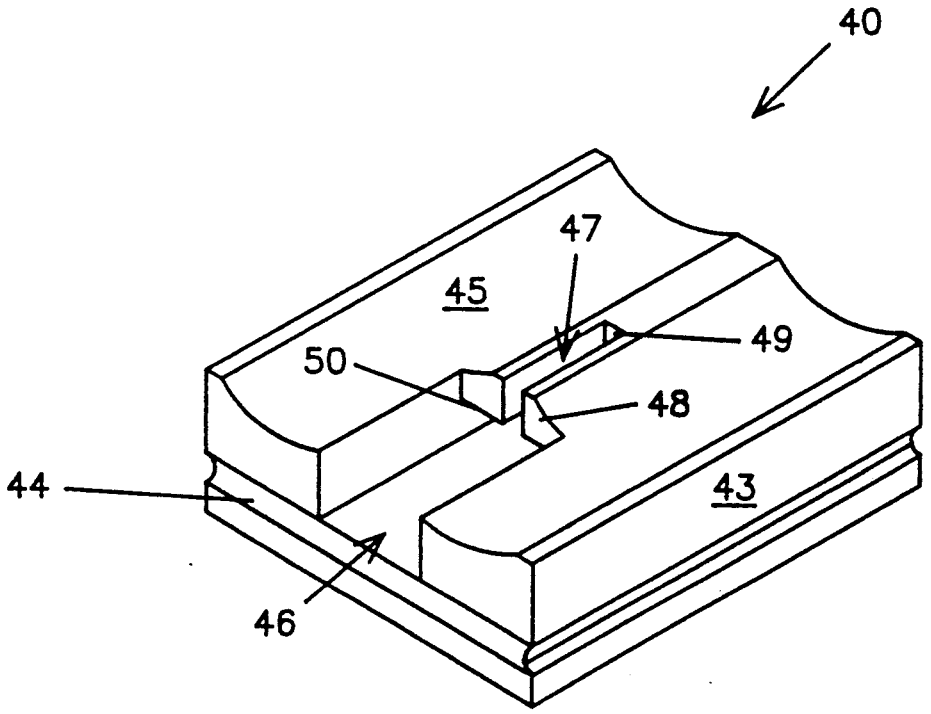
FIG. 6 is an isometric view of the tile shown in FIG. 2.

Tile anchor 60, shown in FIG. 7, includes stem 61 to be mounted on the heat exchanger and sized to pass into slot 47 and be stopped against termination 49. Anchor 60 further includes bar 62 which is sized to pass through groove 46 and under shoulder 48 to engage guiding surface 50 shown in FIG. 5. It will be evident that other groove, slot and associated anchor shapes can be provided to achieve the guided and secured mating between the tile groove and its associated tile anchor.

The tile is mounted on the heat exchanger by buttering the concealed surface of the tile with mortar, pressing tile groove 46 onto the bar of the anchor with the stem of the anchor at the entrance of tile slot 47. Sliding the tile along the bar then engages the bar with tapered surface 50 of shoulder 48, forcing the tile toward the heat exchanger. Finally, sliding the tile further brings the stem against slot termination 49 with the bar against securing surface 51 of the shoulder. Adjacent tile in a desired array are similarly mounted on the heat exchanger.

Figure 8:
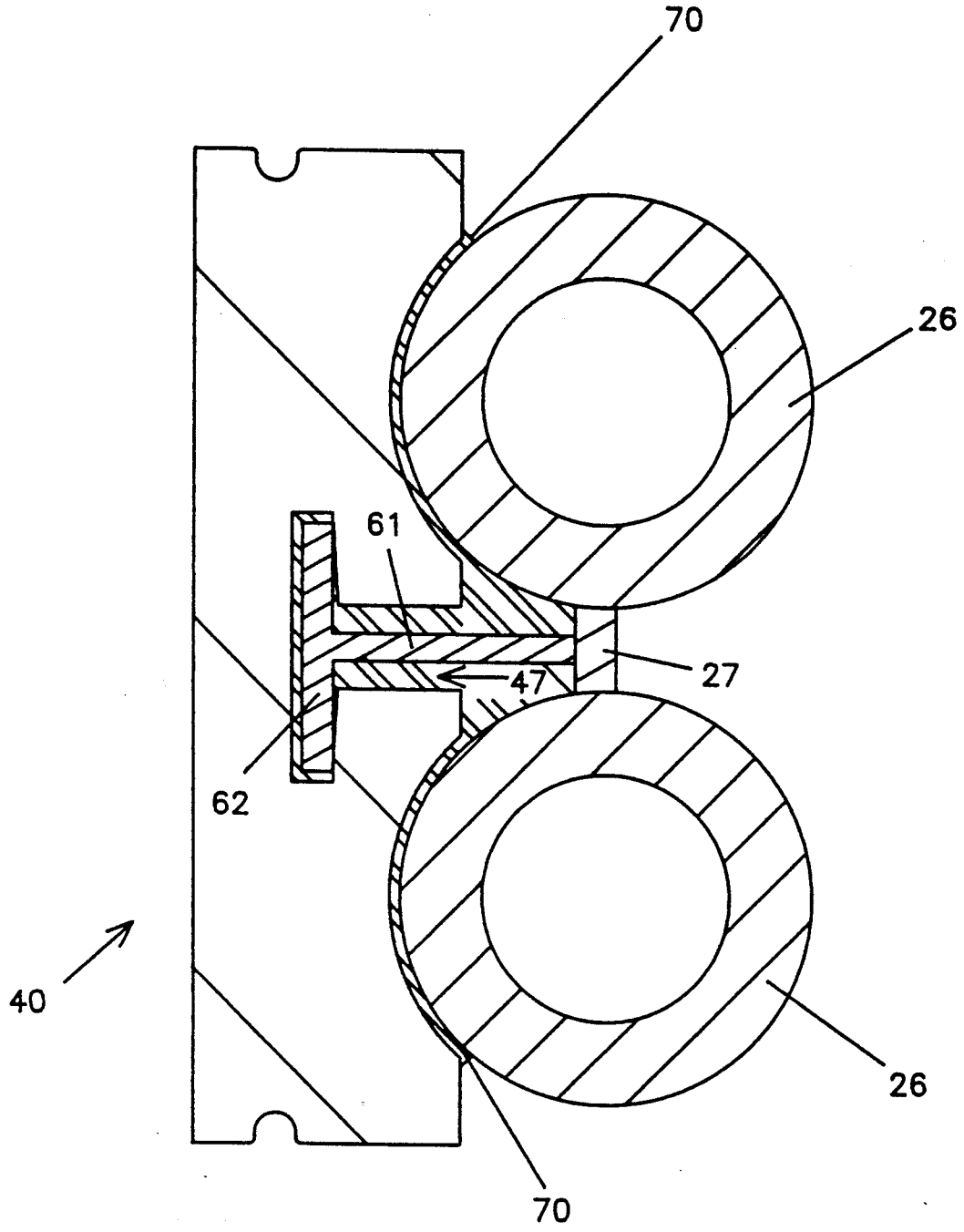
FIG. 8 is a diagramatic cross-sectional view showing a refractory tile system of this invention.

The refractory tile system of this invention, which includes the tile and its associated anchor(s), can be affixed to the heat exchanger in several ways. One of these ways ways is shown in FIG. 8. Tubing 26 in a heat exchanger array is typically joined together with metal fins 27, and it is convenient to simply weld the stem 61 of the anchor to the fin at the correct position on the tubing array. A thermally conductive mortar 70 is applied to the concealed face of the tile before sliding the tile over bar 62 of the T-shaped anchor. The stem of the anchor can be varied in length to optimize contact with the heat exchanger.

One of the features of a preferred tile is that the concealed face 42 will be contoured as necessary to conform as closely to the surface of the heat exchanger as possible for good heat transfer. In the event the heat exchanger is an array of tubing, contour 45 may be adapted to match the tubing. Clearly, the specific contour required to match the heat exchanger surface can be built into the tile at the time of its manufacture.

Figure 9:
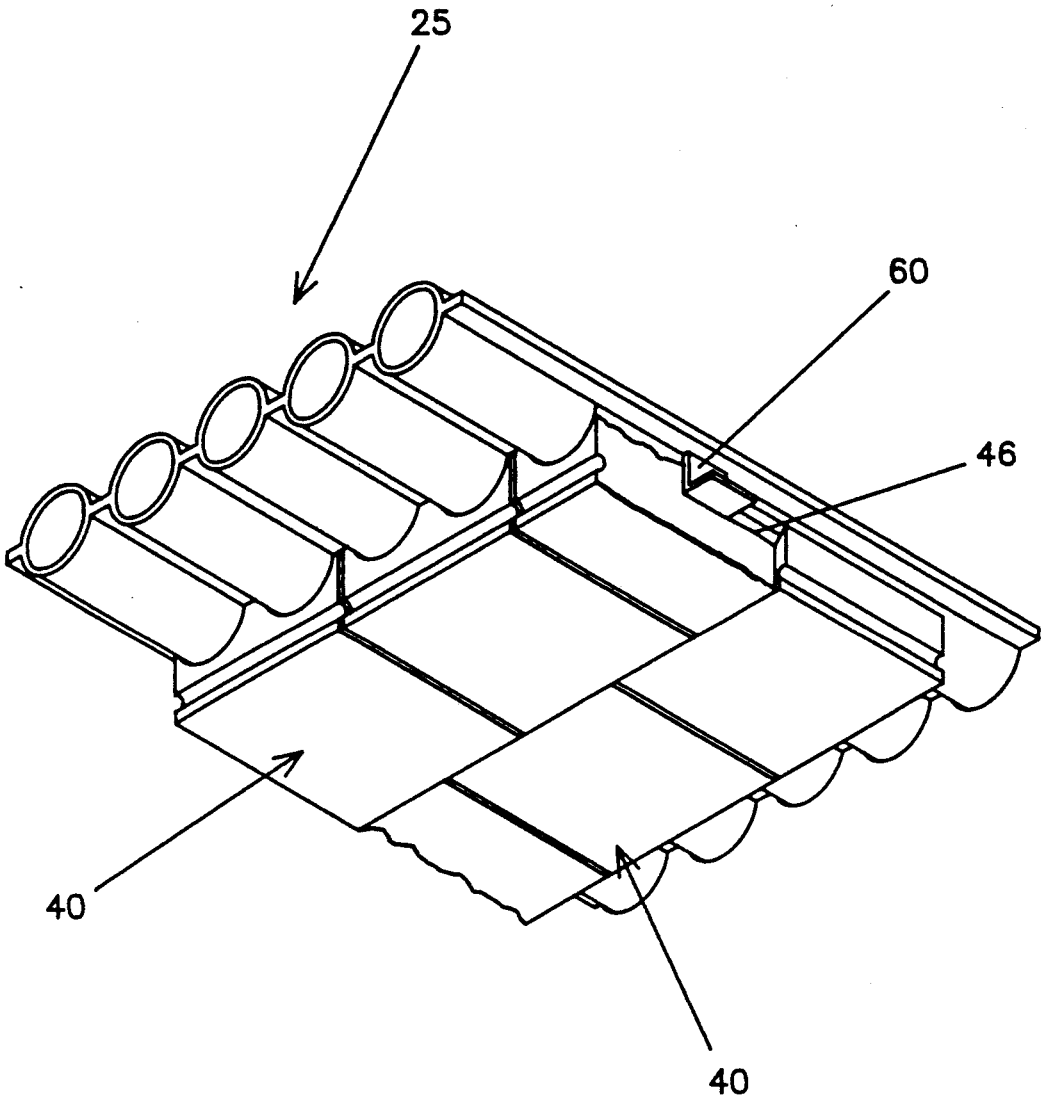
FIG. 9 is an isometric view, with a portion broken away, showing a protective covering of this invention.

The tile is also preferably provided with an edge which carries a recess 44 to receive additional mortar as a plurality of the tile systems are combined to provide the protective covering of this invention as illustrated in FIG. 9.

Although the invention has been illustrated in one or more preferred embodiments, it is not intended nor required that the scope of the invention be limited other than by the following claims.

What is claimed is:

1. A refractory tile adapted for fixation to a heat exchanger to produce, with other tile, a protective covering for said heat exchanger, each of said tile comprising an exposed face;

a concealed face; and an edge spacing said faces apart; said concealed face carrying at least one groove open to said concealed face and extending transversely from said edge, said groove including a terminated slot having a shoulder with an underside, wherein the underside begins with a guiding surface tapered into said groove toward said exposed face and ends with a securing surface paralleling said groove;

whereby said groove is thusly adapted to guide the tile into position and mat the tile securely with at least one anchor mounted on said heat exchanger.

2. The refractory tile of claim 1 wherein said concealed face is contoured to engage said heat exchanger.

3. The refractory tile of claim 1 wherein said edge carries a recess to receive mortar between tile.

4. A refractory tile system comprising (a) a tile which includes an exposed face;

a concealed face; and an edge spacing said faces apart; said concealed face carrying at least one groove open to said concealed face and extending transversely from said edge, said groove including a terminated slot having a shoulder with an underside, wherein the underside begins with a guiding surface tapered into said groove toward said exposed face and ends with a securing surface paralleling said groove; in combination with (b) at least one T-shaped tile anchor having a stem sized to pass along said slot and to be mounted on said heat exchanger, together with a bar to engage said shoulder.

5. A protective covering for a heat exchanger comprising a plurality of refractory tile systems, each comprising (a) a tile which includes an exposed face;

a concealed face; and an edge spacing said faces apart; said concealed face carrying at least one groove open to said concealed face and extending transversely from said edge, said groove including a terminated slot having a shoulder with an underside, wherein the underside begins with a guiding surface tapered into said groove toward said exposed face and ends with a securing surface paralleling said groove; in combination with (b) at least one T-shaped tile anchor having a stem sized to pass along said slot and to be mounted on said heat exchanger, together with a bar to engage said shoulder.

* * * * *